US006223581B1

(12) United States Patent
Zimmer

(10) Patent No.: US 6,223,581 B1
(45) Date of Patent: May 1, 2001

(54) BORDERING DEVICE

(75) Inventor: Ernst Zimmer, Friedberg (DE)

(73) Assignee: Kuka Schweissaniagen GmbH (DE)

( * ) Notice: Subject to any disclaimer, the term of this patent is extended or adjusted under 35 U.S.C. 154(b) by 0 days.

(21) Appl. No.: 09/214,673

(22) PCT Filed: Jul. 1, 1997

(86) PCT No.: PCT/EP97/03428

§ 371 Date: May 19, 1999

§ 102(e) Date: May 19, 1999

(87) PCT Pub. No.: WO98/02260

PCT Pub. Date: Jan. 22, 1998

(30) Foreign Application Priority Data

Jul. 16, 1996 (DE) ..... 296 12 192 U

(51) Int. Cl.[7] ..... B21D 39/02
(52) U.S. Cl. ..... 72/393; 29/243.518
(58) Field of Search ..... 72/306, 353.4, 72/353.6, 393, 391.2; 29/243.518, 243.517, 243.5

(56) References Cited

U.S. PATENT DOCUMENTS

| | | | | |
|---|---|---|---|---|
| 1,242,627 | * | 10/1917 | Winningham | 29/243.518 |
| 1,722,556 | | 7/1929 | Cameron . | |
| 1,823,047 | * | 9/1931 | Hothersall | 72/393 |
| 2,720,241 | * | 10/1955 | Calcaterra | 72/393 |
| 3,566,817 | | 3/1971 | De Coye De Castelet . | |
| 3,621,699 | * | 11/1971 | Valek et al. | 72/353.6 |
| 4,835,825 | * | 6/1989 | Warner | 29/243.518 |
| 5,647,243 | * | 7/1997 | Zampini | 72/315 |

FOREIGN PATENT DOCUMENTS

| | | | | |
|---|---|---|---|---|
| 43 30 683 C2 | | 7/1995 | (DE) . | |
| 2 645 053 | * | 10/1990 | (FR) | 29/243.517 |
| 2 651 699 | | 3/1991 | (FR) . | |
| 623266 | * | 7/1961 | (IL) | 72/353.4 |
| WO 95/21711 | | 8/1995 | (WO) . | |

* cited by examiner

*Primary Examiner*—Lowell A. Larson
(74) *Attorney, Agent, or Firm*—McGlew and Tuttle, P.C.

(57) ABSTRACT

The present invention pertains to a hemming device 1 with a hemming head 6, which has one or more hemming tools 8, 9, divided into segments 12 through 16 in the case of a plurality of hemming tools, wherein the hemming tool or hemming tools is/are provided with a hemming edge 11 rotating in the operating position. The hemming device 1 also has a stroke drive for generating the hemming stroke and an adjusting device 22 for withdrawing and extending the segments 12 through 16, which has an adjusting drive 23, which moves all segments 12 through 16 simultaneously. The segments have adapted contact surfaces 17, which have a contact angle α of 20° to 50°. The adjusting drive 23 is preferably designed as a crank mechanism.

20 Claims, 6 Drawing Sheets

BORDERING DEVICE

FIELD OF THE INVENTION

The present invention pertains to a hemming device for inner hemming with a hemming head having one or more hemming tools divided into segments. The hemming tool or hemming tools is/are provided with a hemming edge, with a stroke drive for generating the hemming stroke and with an adjusting means for retracting and extending the segments. The adjusting means has an adjusting drive which moves all the segments.

BACKGROUND OF THE INVENTION

Various designs of such hemming devices have been known from practice. They have a hemming head, which has one hemming tool or a plurality of hemming tools divided into segments. The hemming tool or hemming tools is/are provided with a hemming edge rotating in the operating position. The hemming device also has a stroke drive for generating the hemming stroke and an adjusting means for retracting and extending the segments. Such hemming devices are intended mainly for workpieces with an internal opening, e.g., vehicle doors with a window opening. In the retracted resting position of the segments, the hemming head can move up and down in the opening of the workpiece. In the extended operating position, the segments bead the sheet metal edges. The prior-art hemming devices have an adjusting means, which operates in one step or two steps and moves the segments in two or more groups one after the other. This requires a plurality of drives and implies a more complicated control and design. In addition, this technique is to the detriment of the cycle time.

SUMMARY AND OBJECTS OF THE INVENTION

The primary object of the present invention is to provide a better hemming device.

The present invention accomplishes this object with a plurality of hemming segments each including a hemming edge and a contact surface. An adjusting means connects to the plurality of hemming segments and holds the hemming segments movable between a retracted position and an extended position. The hemming segments are positioned in the extended position to have the contact surfaces abut each other flush and to have the hemming edges align to form a single continuous hemming edge. The adjusting means also includes an adjusting drive for moving the hemming segments simultaneously.

All segments can be moved simultaneously and require only one drive in the case of the hemming device according to the present invention. The hemming device according to the present invention is less expensive, more economical and faster as a result.

The contact surfaces of the segments are adapted to the kinematics. To avoid incidents, wedge angles between 20° and 50° and preferably between 35° and 40 are recommended.

The preferred embodiment of the adjusting drive as a crank mechanism offers a stable and highly accurate design. The cranks assume a stretched position in the operating position and safely support the segments against the hemming forces. Due to the cranks being arranged at different levels on the crankshaft, the cranks can rotate independently from one another and without mutually disturbing one another, and they are able to perform feed strokes of different lengths. The segments can be moved at different velocities with this crank kinematics and they mutually evade each other. This is especially advantageous when the hemming edge goes around the corner and the feed axes of the segments are oriented at angles in relation to one another.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
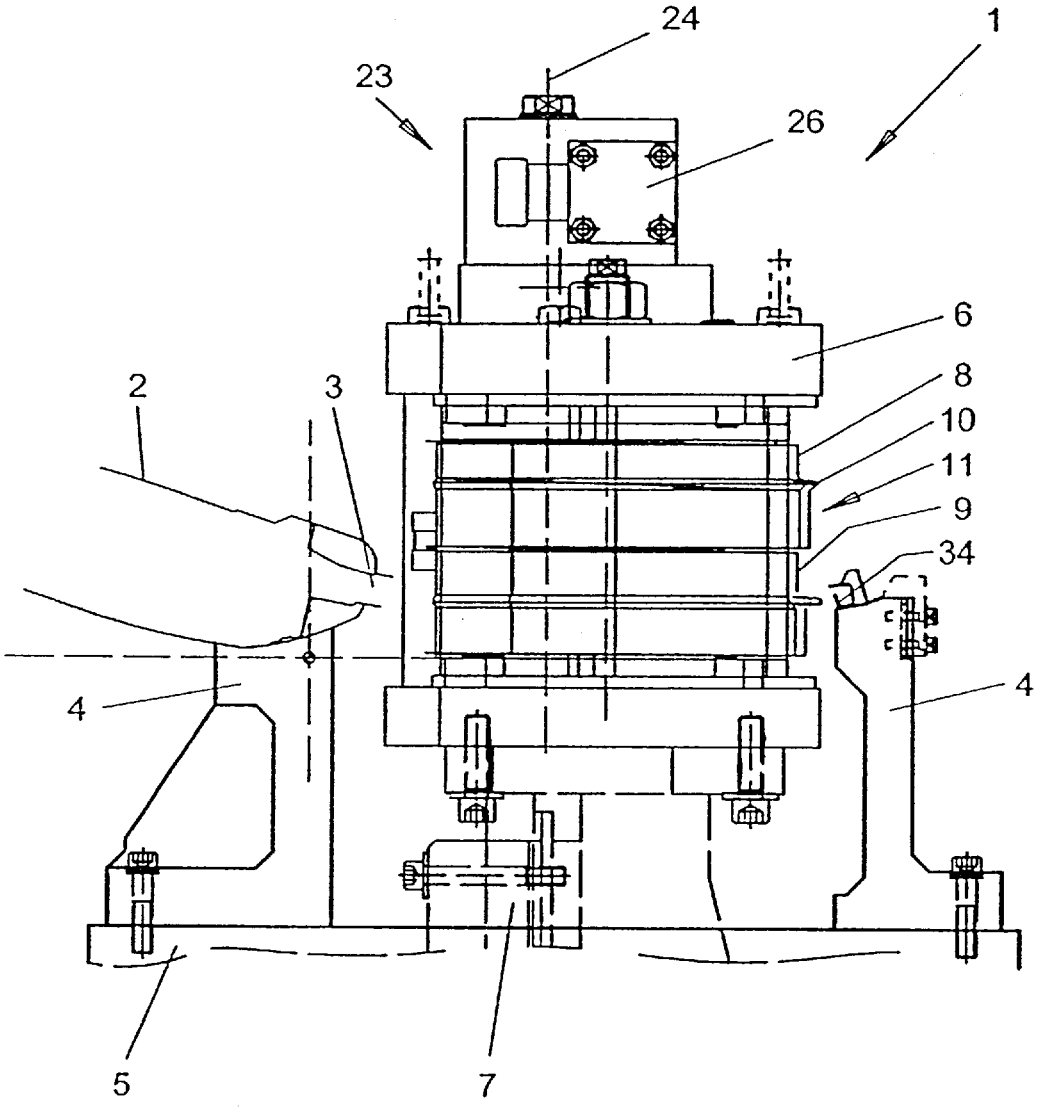
FIGS. 1 and 2 are a side view and a longitudinal view of the hemming device.
Figure 2:
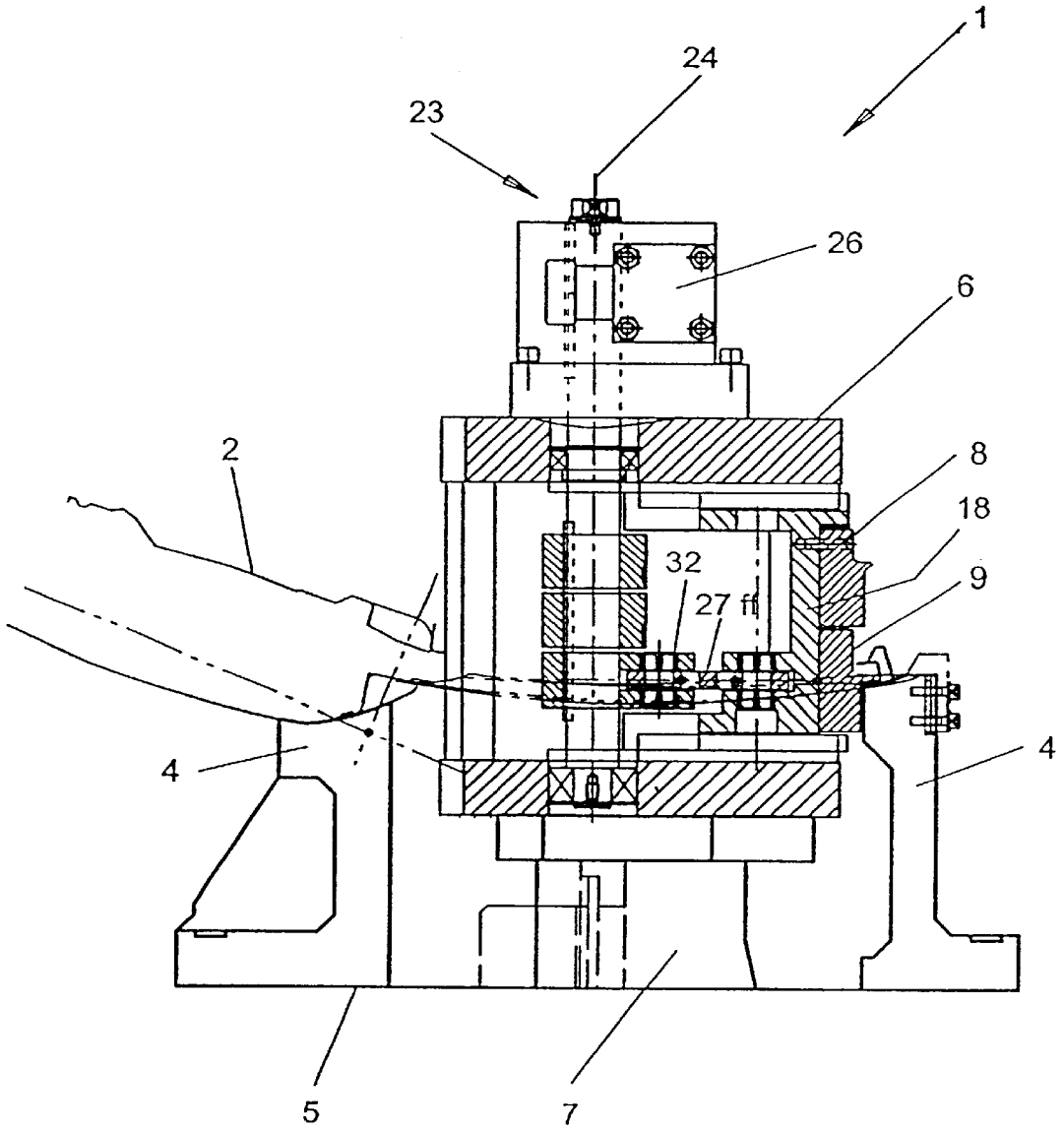

Referring to the drawings, FIGS. 1 and 2 show an uncut side view of the hemming device 1 and a longitudinal section from the same direction The hemming device 1 is used to process a workpiece 2, which is, e.g., a vehicle door with a window opening 3. The hemming device 1 is located in the workpiece opening 3 or in the window opening and is used to hem the inner sheet metal edges 34 extending all round with corners.

The workpiece 2 rests on a suitable workpiece mount 4, which is fixed thereto. The workpiece mount 4 surrounds the hemming device 1.

The hemming device 1 has a stroke drive and guide unit 7 with a hemming head 6 movable therewith and with a frame 5. The hemming head 6 performs vertical stroke or hemming movements which are vertical in the exemplary embodiment shown by means of the stroke drive 7. As a variant, the hemming stroke may also be horizontal or oblique if the device is designed correspondingly.

Figure 3:
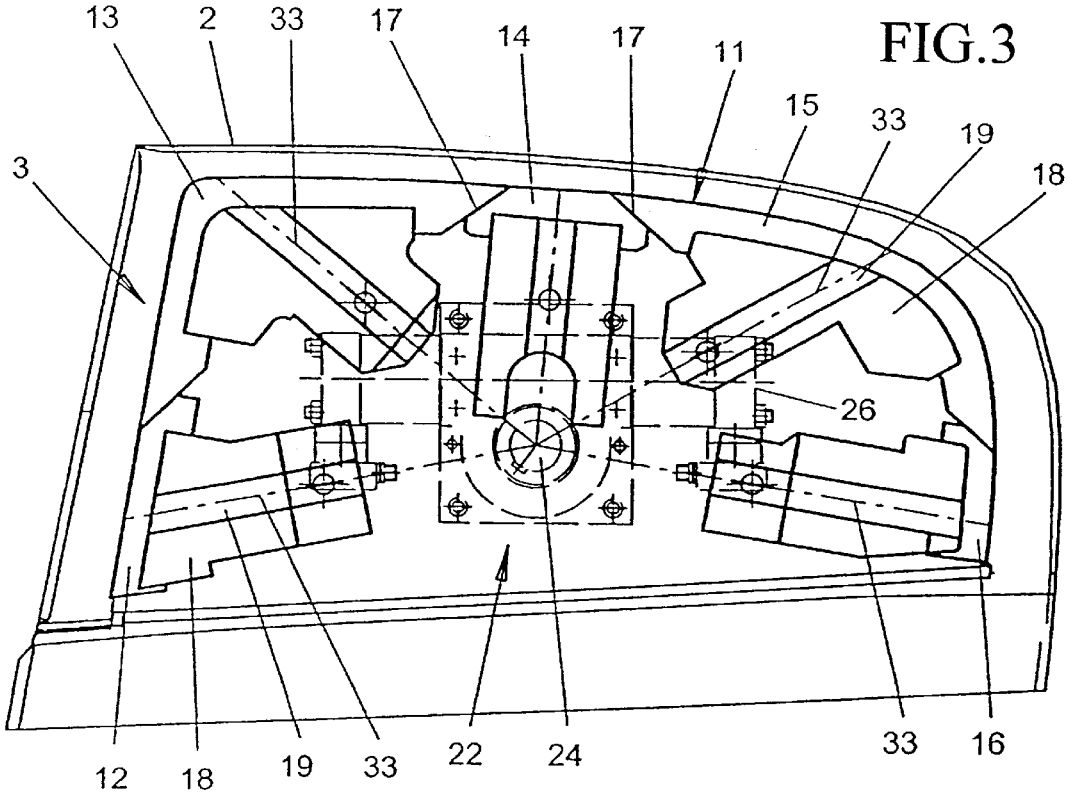
FIGS. 3 and 4 are a top view and the extended operating position as well as the retracted resting position of a hemming head with five segments.

The hemming head 6 has one or more hemming tools 8, 9, which form a diagonally extending hemming edge 11 in the operating position see FIG. 3. In the exemplary embodiment shown, the hemming tools 8, 9 are arranged one on top of another, the upper hemming tool 8 being used for pre-hemming and the lower hemming tool 9 being used for finishing hemming.

The hemming tools 8, 9 comprise a plurality of hemming segments 12, 13, 14, 15, 16 each, which are arranged movably at right angles to the direction of the stroke and can be extended and withdrawn with an adjusting drive 22. In the extended operating position according to FIG. 3, the hemming segments 12, 13, 14, 15, 16 abut against each other flush and form the circular, interrupted hemming edge 11 with their outer surfaces. In the withdrawn resting position according to FIG. 4, the segments 12, 13, 14, 15, 16 are retracted to different extents or distances and have a reduced outer circumference. In this position, the hemming head 6 is able to move up and down through the workpiece opening 3 and it also permits the workpiece to be changed. FIG. 1 illustrates the retracted position and FIG. 2 shows the operating position in a side view.

As is apparent from FIGS. 3 through 6, the circular hemming edge 11 is angulated or bent corresponding to the shape of the window. There is at least one corner or bend, but there are preferably a plurality of corners or bends. The segments 12, 13, 14, 15, 16 are correspondingly distributed all around and are present in a corresponding number. There are five segments 12, 13, 14, 15, 16 in FIGS. 3 and 4. There are three segments 12, 13, 14 each in FIGS. 6 and 7. At least some of the segments may in turn be bent and their hemming edge sections may form comers.

The hemming edges 11 comprise essentially a vertical or oblique sliding surface to bend the upright sheet metal edges and sheet metal inner edges 34. The sliding surface terminates in a projecting hemming nose 10 in both hemming tools 8, 9. The slope of the surfaces and the rounding of the transition into the hemming nose 10 are different in order to first bring the sheet metal edges into an oblique position during pre-hemming and then to fold them over during finishing hemming. These two operations are together known as hemming.

The segments 12, 13, 14, 15, 16 are driven by the adjusting means 22 together and are moved simultaneously. They perform feed strokes of different lengths at different velocities. As is apparent from FIGS. 3 through 7, the segments 12, 13, 14, 15, 16 also have heads of different width. The segments with the broader heads are preferably located in comer areas and those segments with the narrower heads are between the broader heads. The segments with the narrower heads preferably move faster and with longer strokes than the segments with the broader heads.

The segments 12, 13, 14, 15, 16 have oblique contact surfaces 17 at the heads. With these contact surfaces the segments touch one another in the extended operating position. There is a distance between the contact surfaces 17 in the retracted resting position.

The contact surfaces 17 are adapted to the kinematics required by the simultaneous movement of the segments and they permit a collision-free separation of the segments 12, 13, 14, 15, 16 from one another and their trouble-free retracing and feed movement. The contact surfaces 17 have an acute wedge angle a each with the adjacent hemming edge 11, which is between 20° and 50° and preferably between 30° and 45°.

Figure 5:
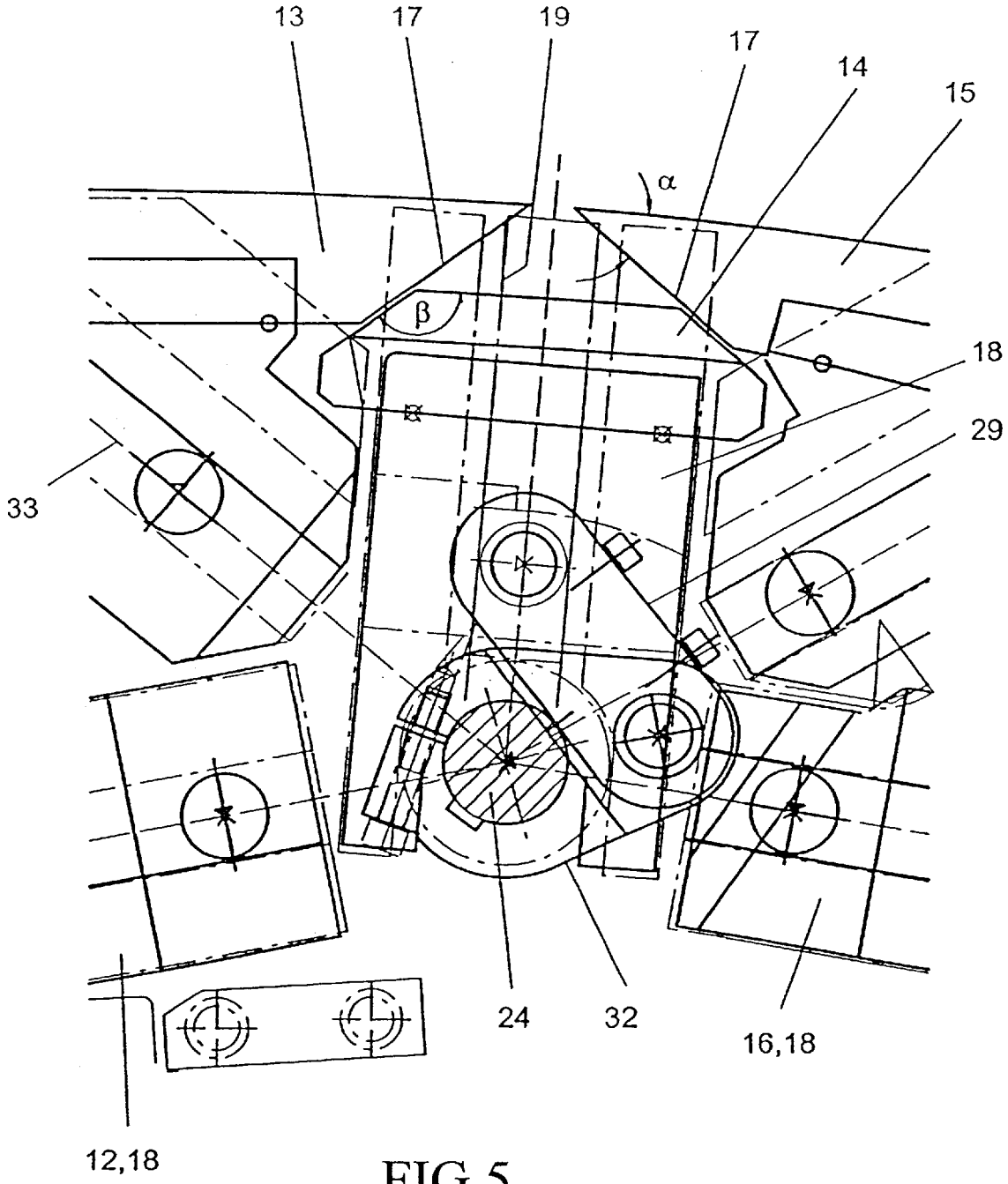
FIG. 5 is an enlarged detail of individual segments.

As is illustrated in FIGS. 3 and 5, the contact surfaces 17 are sloped altermatingly to the right and left. The segments 12, 14, 16,with the narrower heads preferably have one or two obliquely outwardly placed contact surfaces 17. A complementary angle β of 180° is obtained as a result. The segments 13,15 with the broader heads have, in contrast, two recessed contact surfaces 17, which directly form the wedge angle a at the tip.

The adjusting drive 22 may have various different designs. It is designed as a crank mechanism 23 in the preferred embodiment. In the exemplary embodiment shown in FIGS. 3 through 6, the crank mechanism 23 has a crankshaft 24. In the exemplary embodiment according to FIG. 7, a second, parallel crankshaft 25 is present as an auxiliary shaft, which is connected to the main shaft 24 directly via a coupling rod 35 or indirectly via the drive and rotates together with the coupling rod. The crankshafts 24, 25 extend along the direction of stroke of the hemming head 6. The crankshaft 24 has a rotary drive 26, which may be designed, e.g., as a hydraulic drive. In a modified embodiment, there may be two coupled drives in the double crankshaft arrangement.

Figure 4:
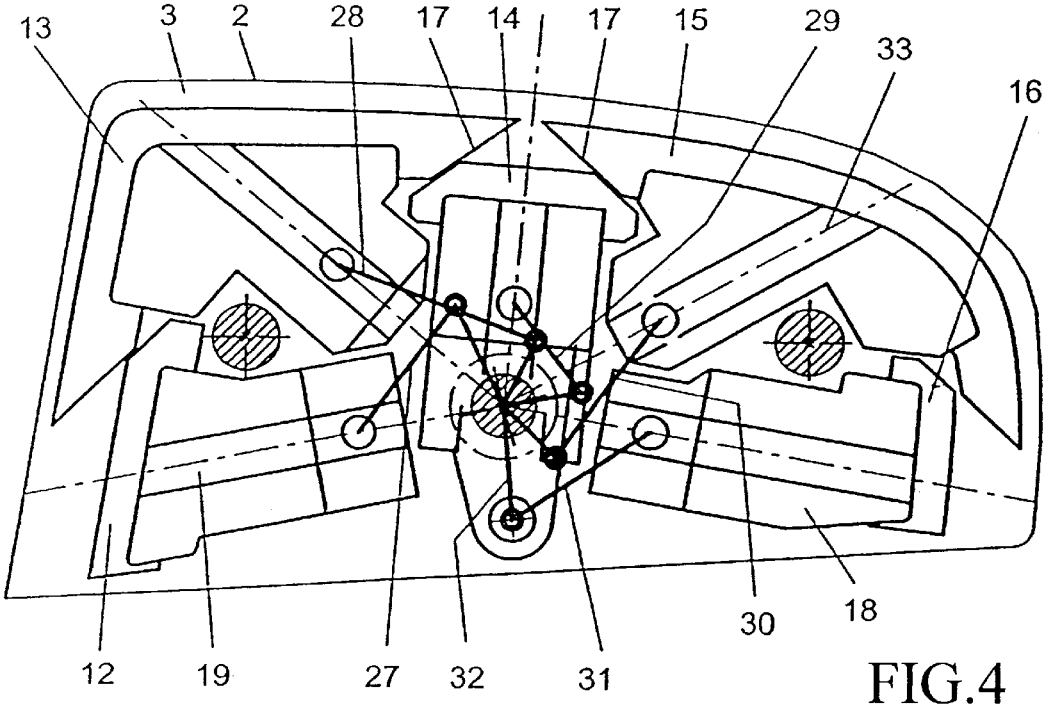

The crank arrangements are formed by extension arms 32 at the crankshafts 24, 25 and by connecting rods 27,28,29, 30,31, which are articulated to the segments 12, 13, 14, 15, 16. FIG. 4 schematically shows the crank arrangement. FIG. 5 shows an individual crank for the segment 14. The others are omitted for clarity's sake. As is illustrated in FIG. 4, the cranks have different lengths. The hinge points at the extension arms 32 have different distances from the crankshaft 24, 25, and the connecting rods 27, 28, 29, 30, 31 also have different lengths. This crank geometry is used to generate feed strokes of different length and velocity of the segments 12, 13, 14, 15, 16.

As is illustrated by the longitudinal section in FIG. 2, the cranks with their extension arms 32 are arranged at different levels on the crankshaft 24, 25. As a result, they move in different positions one on top of another, without mutually disturbing one another. The connecting rods 27, 28, 29, 30, 31 and extension arms 32 are correspondingly flat.

Figure 6:
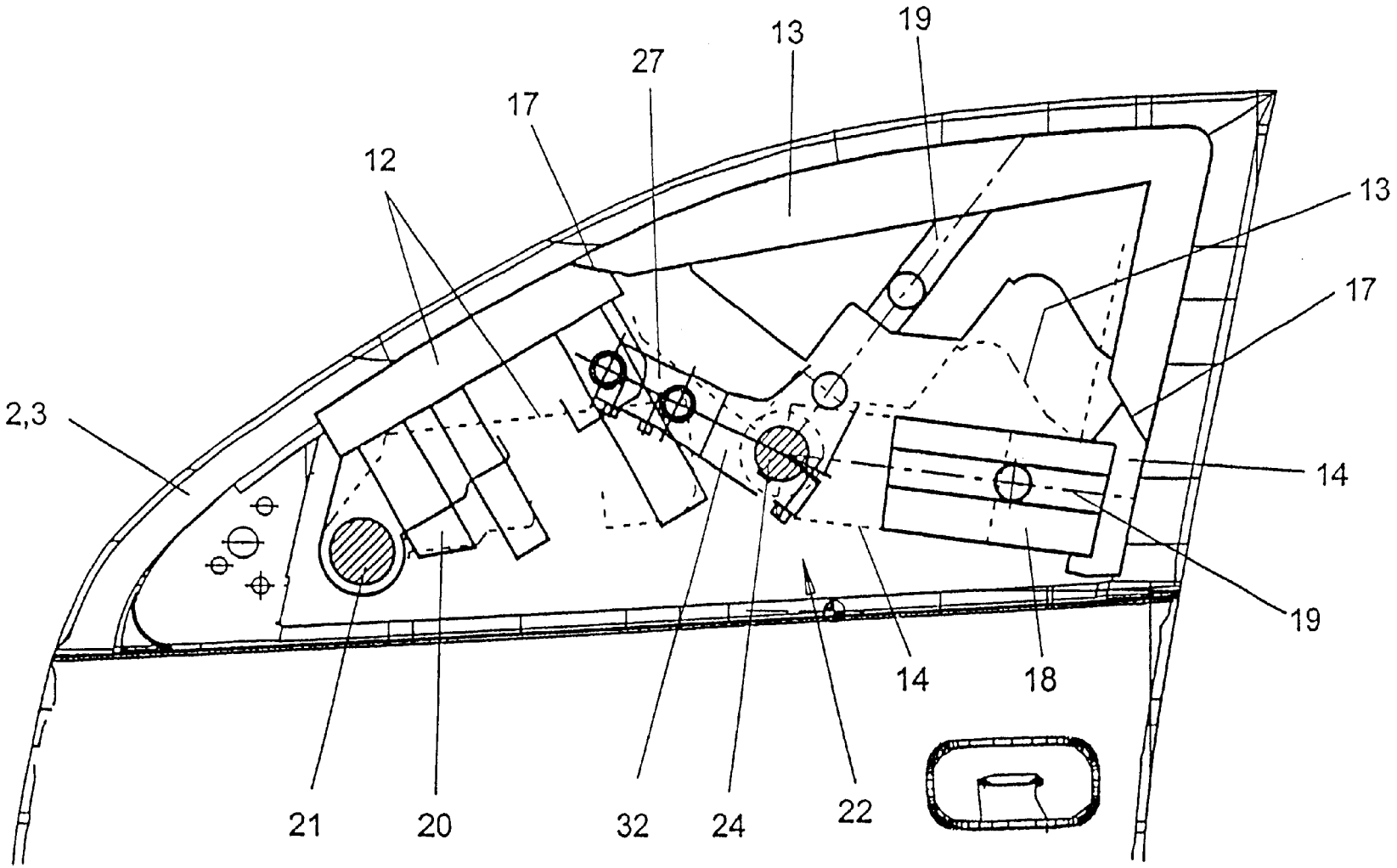
FIGS. 6 and 7 are variants of the hemming head with various segment designs.
Figure 7:
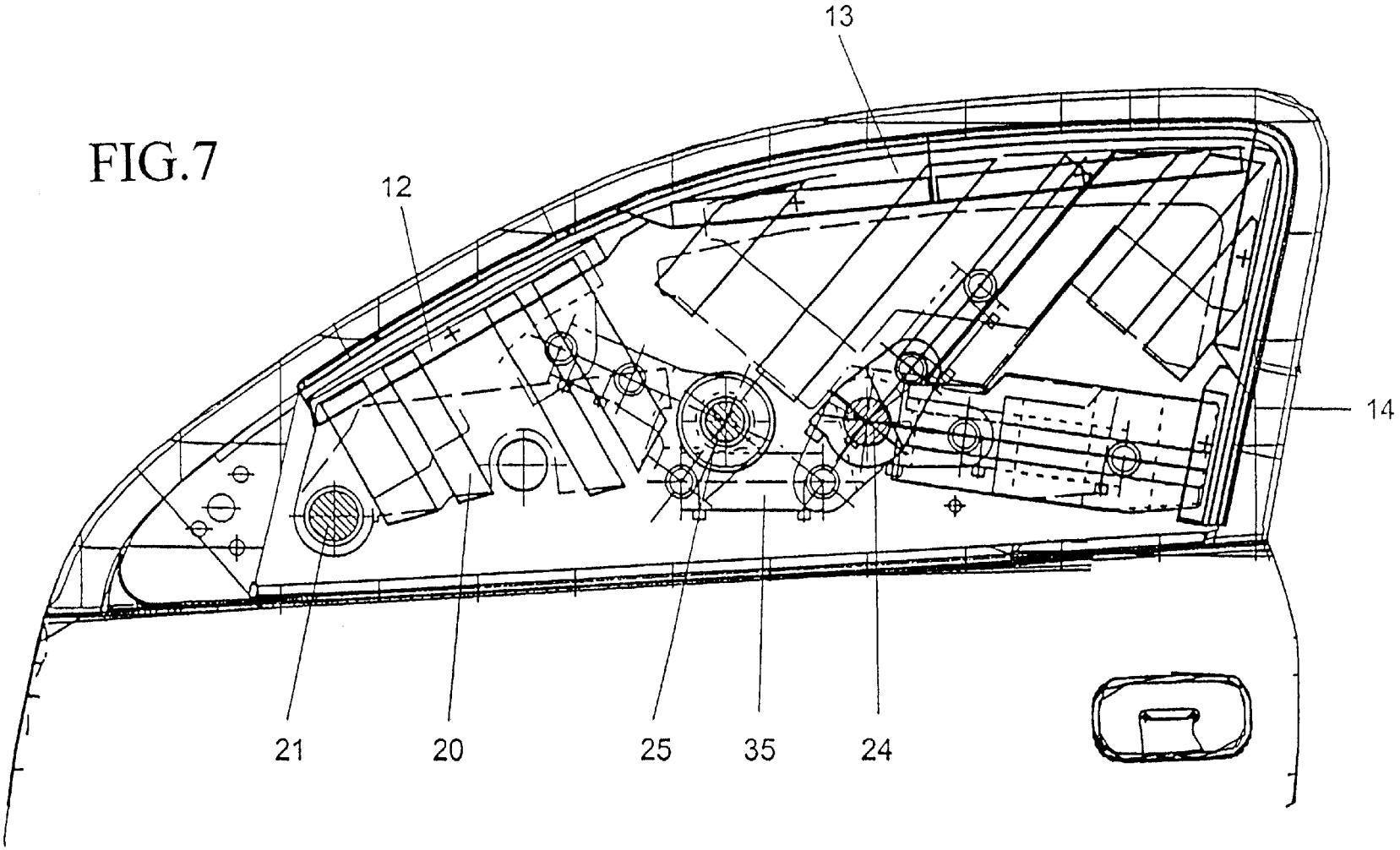

The segments 12, 13, 14, 15, 16 have carriers 18, 20, with which they are accurately guided. The carriers 18 are designed as slides, which are moved along a straight-line motion 19. The carriers 20 in FIGS. 6 and 7 are designed as swivel plates, which rotate around a drag bearing 21 oriented along the crankshaft 24, 25. The operating positions of the segments 12, 13, 14 are indicated by solid lines and the retracted positions by broken lines in FIGS. 6 and 7. The supports 18, 20 are shaped such that they are fitted into one another rather accurately in the retracted position and, on the other hand, do not collide with obstacles inside the hemming head 6, e.g., tie rods passing through, etc.

The crank mechanism 23 is designed in the various exemplary embodiments such that the cranks, i.e., the connecting rods 27, 28, 29, 30, 31 and extension arms 32 assume a stretched position in the extended operating position. In this position, they optimally support the hemming forces acting along the feed axes 33. The transversely or obliquely directed forces are supported by the guides 19 and the drag bearing 21.

It is advantageous for constructing the hemming head 6 and its segments 12, 13, 14, 15, 16 to first define a segment in terms of the direction and the amount of the feed stroke. This is preferably the bulkiest segment and a corner part. It is recommended that a short stroke be imparted to this segment and thus to set the disturbing edge for the collision-free passage in the workpiece opening 3. The other segments 12, 13, 14, 15, 16 are then divided among one another, and their feed axes 33 preferably have essentially the same angles among one another. The intersections, i.e., the position of the contact surfaces 17, are set at the same time. As is illustrated by the top views, segments with narrow heads alternate with segments having broad heads. Correspondingly, the strokes are alternatingly long and short. In the case of the first segment defined at the beginning, the feed stroke and the direction of feed along the feed axis 33 are marked at the intersection, i.e., at the point of intersection of the hemming edge 11 and the contact surface 17. The stroke and direction are then likewise marked at this intersection for the adjacent segment. The two end points of these sections are connected. This connection line is then rotated back by about 2° to 15° in order to guarantee the clearance necessary in the retracted position. In its end position, this connection line will then form the contact surface 17. The wedge angles a will be obtained spontaneously according to this method. This construction is applied to the other segments one after the other. The construction may still be subsequently optimized.

Modifications of the exemplary embodiments described are possible in various ways. On the one hand, the hemming edge 11 may be lead around not only in an open arch bent once or several times, but also in a closed arch.

However, hemming on the three upper sides of the opening is sufficient in the preferred application for hemming doors. The segment heads and the hemming edge 11 are bent convexly in the exemplary embodiments shown. As an alternative, they may also be bent concavely or be straight at least in some areas. The outsides of a workpiece 3 may also be processed with a modified design of a hemming head 6. The hemming device 1 does not have to extend through the workpiece opening 3, but it may also be located at the outer edge of a workpiece 3.

In another variant, the adjusting drive 22 may also have a different design. Instead of a crank mechanism 23, there also may be, e.g., a drive with a plurality of mutually actuated adjusting cylinders or other similar suitable drive elements. The guiding of the segments may also be designed differently.

While specific embodiments of the invention have been shown and described in detail to illustrate the application of the principles of the invention, it will be understood that the invention may be embodied otherwise without departing from such principles.

LIST OF REFERENCE NUMBERS

1 Hemming device
2 Workpiece, door
3 Opening, window opening
4 Workpiece mount
5 Frame
6 Hemming edge
7 Stroke drive
8 Hemming tool, pre-hemming
9 Hemming tool, finishing hemming
10 Hemming nose
11 Hemming edge
12 Segment
13 Segment
14 Segment
15 Segment
16 Segment
17 Contact surface
18 Carrier, slide
19 Guide
20 Carrier
21 Drag bearing
22 Adjusting means
23 Adjusting drive, crank mechanism
24 Crankshaft
25 Crankshaft, auxiliary shaft
26 Rotary drive
27 Connecting rod
28 Connecting rod
29 Connecting rod
30 Connecting rod
31 Connecting rod
32 Extension arm
33 Feed axes
34 Sheet metal edge, sheet metal inner edge
35 Coupling rod

What is claimed is:

1. A hemming device for inner hemming, the device comprising:

a plurality of hemming segments each including a hemming edge and a contact surface;

an adjusting drive connecting to each of said plurality of hemming segments and holding said hemming segments and moving the hemming segments simultaneously between a radially inward retracted position and radially outward extended working position for inner hemming of an inner surface of a workpiece surrounding said hewing segments, said hemming segments being positioned in said extended working position to have said contact surfaces abut each other flush and to have said hemming edges align to form a single continuous hemming edge, said adjusting drive including an adjusting drive for directly and simultaneously moving said hemming segments in a feed motion between said retracted position and said extended working position; and a stroke drive operatively connected to said segments for moving said segments in said extended position in a hemming stroke, essentially at right angles to said feed motion, said hemming stroke being essentially linear.

2. A hemming device in accordance with claim 1, wherein:

said plurality of hemming segments form a plurality of hemming tools in a hemming head; and said single continuous hemming edge is curved and forms an inside bead corner area in a sheet.

3. A hemming device in accordance with claim 1, wherein:

said adjusting drive moves said hemming segments over feed paths of different lengths and at different feed velocities.

4. A hemming device in accordance with claim 1, wherein:

one of said contact surfaces has a wedge angle $\alpha$ of 20°–50° with said hemming edge.

5. A hemming device in accordance with claim 1, wherein:

said adjusting drive includes a crank mechanism.

6. A hemming device in accordance with claim 5, wherein:

said crank mechanism includes a crank shaft, said crank mechanism includes extension arms and connecting rods connecting said crankshaft to said hemming segments.

7. A hemming device in accordance with claim 6, wherein:

said connecting rods are arranged at different levels.

8. A hemming device in accordance with claim 6, wherein:

said crank mechanism includes another crank shaft, said extension arms and said connecting rods connecting said crankshaft and said another crankshaft to said hemming segments.

9. A hemming device in accordance with claim 6, wherein:

said connecting rods and said extension arms have different lengths.

10. A hemming device in accordance with claim 6, wherein:

said connecting rods and said extension arms assume a stretched position in said extended position of said hemming segments.

11. A hemming device in accordance with claim 6, wherein:

said connecting rods and said extension arms are fully extended when said hemming segments are in said extended position.

12. A hemming device in accordance with claim 1, wherein:

said hemming segments are one of guided in a substantially straight line and mounted pivotally.

13. A hemming device in accordance with claim 1, wherein:

each of said hemming segments move along a respective feed axis, angles between adjacent said feed axes being substantially identical.

14. A hemming device in accordance with claim 1, wherein:

said contact surfaces are spaced from each other when said hemming segments are positioned in said retracted position.

15. A hemming device in accordance with claim 1, wherein:

different said hemming segments are spaced different distances between said retracted and extended positions.

16. A hemming device in accordance with claim 1, further comprising:

a first hemming tool formed from said plurality of hemming segments;

another plurality of hemming segments forming a second hemming tool;

a hemming head including said first and second hemming tools, said stroke drive moving said head in a stroke movement, said first hemming tool having a shape to form an edge of a work piece into an oblique position during said stroke movement, said second hemming tool having a shape to form an oblique edge of the work piece into a folded over position during said stroke movement, said stroke movement is substantially perpendicular to movements of said hemming segments between said retracted position and said extended position, said stroke movement and said first and second hemming tools perform a hemming operation on the workpiece edge.

17. A hemming device for inner hemming, the device comprising:

a plurality of first hemming segments each including a hemming edge and a contact surface, said plurality of first hemming segments forming a first hemming tool;

a plurality of second hemming segments each including a hemming edge and a contact surface, said plurality of second hemming segments forming a second hemming tool;

an adjusting drive connected to said first plurality of hemming segments and holding said first plurality of hemming segments movable between a radially inwardy retracted position and a radially outwardly extended position for inner hemming of an inner surface of a workpiece surrounding said hemming segments, said first hemming segments being positioned in said extended position to have said contact surfaces abut each other flush and to have said hemming edges align to form a single continuous hemming edge, said adjusting drive moving said first hemming segments simultaneously, said adjusting drive being connected to said second plurality of hemming segment and holding said second pluarity of hemming segments movable between a radially inwardly retracted position and a radially outwardly extended position for inner hemming of an inner surface of a workpiece surrounding said hemming segments, said second hemming segments being positioned in said extended position to have said contact surfaces abut each other flush and to have said hemming edges align to form a single continuous hemming edge, said adjust drive moving said second hemming segments simultaneously;

a hemming head including said first and second hemming tools;

a stroke drive moving said hemming head in a stroke movement, said first hemming tool having a shape to form an edge of a work piece into an oblique position during said stroke movement to provide a prehemming operation, said second hemming tool having a shape to form an oblique edge of the work piece into a folded over position during said stroke movement to provide a final hemming operation.

18. A hemming device in accordance with claim 17, wherein:

said stroke movement is substantially axial and perpendicular to movements of said first hemming segments and said second hemming segments between said retracted position and said extended position, each of said hemming segments having a defined wedge angle.

19. A hemming device in accordance with claim 17, wherein:

said stroke movement and said first and second hemming tools perform a hemming operation on the workpiece edge and said adjusting drive includes a crank mechanism acting on each of said first hemming segments and act on each of said second hemming segments, said crank mechanism including a crank shaft, extension arms and connecting rods connecting said crankshaft to respective said hemming segments with said connecting rods being arranged at different levels corresponding to the respective first hemming segments and second hemming segments.

20. A hemming device for inner hemming, the device comprising:

a plurality of hemming segments each including a hemming edge and a contact surface;

an adjusting drive connected to each of said plurality of hemming segments and positioning said hemming segments in a feed motion between a radially inwardly retracted position and a radially outwardly extended working position for inner hemming of an inner surface of a workpiece surrounding said hemming segments, said hemming segments being positioned in said extended working position to have said contact surfaces abut each other flush and to have said hemming edges align to form a single continuous hemming edge, said adjusting drive being a unitary drive with a crank drive acting on all of said hemming segments for moving said hemming segments simultaneously in said feed motion from said retracted position to said extended working position and from said extended working position to said retracted position, said contact surfaces being spaced from each other when said hemming segments are positioned in said retracted position; and a stroke drive operatively connected to said segments for axially moving said segments in said extended position in a hemming stroke, essentially at right angles to said feed motion, said hemming stroke being essentially linear, said stroke drive being separate from said adjusting device and performing separate movements from said adjusting device.

* * * * *